US011078744B2

(12) United States Patent
Kennedy

(10) Patent No.: US 11,078,744 B2
(45) Date of Patent: Aug. 3, 2021

(54) DOWNHOLE PLUG

(71) Applicant: Shale Oil Tools, LLC, Sugar Land, TX (US)

(72) Inventor: Brian Kennedy, Sugar Land, TX (US)

(73) Assignee: Shale Oil Tools, LLC, Rosenberg, TX (US)

( * ) Notice: Subject to any disclaimer, the term of this patent is extended or adjusted under 35 U.S.C. 154(b) by 231 days.

(21) Appl. No.: 15/961,359

(22) Filed: Apr. 24, 2018

(65) Prior Publication Data

US 2019/0323315 A1 Oct. 24, 2019

(51) Int. Cl.
*E21B 33/12* (2006.01)

(52) U.S. Cl.
CPC ..... *E21B 33/1208* (2013.01)

(58) Field of Classification Search
CPC ... E21B 33/1208; E21B 33/128; E21B 33/134
See application file for complete search history.

(56) References Cited

U.S. PATENT DOCUMENTS 3,160,209 A * 12/1964 Bonner ..... E21B 23/065 166/63
4,493,374 A * 1/1985 Magee, Jr. ..... E21B 33/1295 166/106
4,784,226 A * 11/1988 Wyatt ..... E21B 23/06 166/182
8,079,413 B2 * 12/2011 Frazier ..... E21B 33/134 166/124
8,459,346 B2 * 6/2013 Frazier ..... E21B 33/134 166/124
9,506,309 B2 * 11/2016 Frazier ..... E21B 33/00
10,428,616 B2 * 10/2019 Dirocco ..... E21B 33/1294
2014/0190682 A1 * 7/2014 Greenlee ..... E21B 33/13 166/118
2016/0376869 A1 * 12/2016 Rochen ..... E21B 33/129 166/135
2018/0252067 A1 * 9/2018 Fripp ..... E21B 33/12
2018/0363409 A1 * 12/2018 Frazier ..... E21B 33/1285
2019/0106962 A1 * 4/2019 Lee ..... E21B 23/06
(Continued)

*Primary Examiner* — Daniel P Stephenson
(74) *Attorney, Agent, or Firm* — The Kubiak Law Firm PLLC

(57) ABSTRACT

In wellbore completions it is sometimes desirable to seal the wellbore against fluid flow or to anchor a component within the wellbore. However, running such a plug into the wellbore has been problematic on occasion such as when the nose of the plug encounters an object within the wellbore such as a sand bridge or other obstruction. In those instances, the way of the tubular pushing the plug into the wellbore combined with the nose of the plug being unable to pass the instruction causes the plug to prematurely set. Such an instance the plug may need to be drilled out in order to proceed. In the present embodiment the tubular used to move the plug into the well is attached to the nose of the plug so that the force provided to the plug by the tubular is transmitted only to the nose of the plug preventing the plug from presetting and allowing the plug to push past or through an obstacle within the wellbore. In addition is envisioned that the plug may incorporate compartment that the plug within which may be placed a chemical, electronics, sensors, or other items as desired by the operator.

16 Claims, 4 Drawing Sheets

(56) References Cited

U.S. PATENT DOCUMENTS

2019/0144733 A1* 5/2019 Fripp ..... C09K 8/426
166/387
2019/0323315 A1* 10/2019 Kennedy ..... E21B 33/1208

* cited by examiner

DOWNHOLE PLUG

BACKGROUND

Plugs are usually used to close or seal lower portions of a wellbore. Such bridging or plugging operations are often employed, for example, to seal a lower portion of the well for a fracking operation, when a lower zone in the well has ceased to be productive, where the wellbore has been drilled into a porous formation, or for any other reason where it may be desired to plug or close-off a lower zone and produce from or pressurize a higher zone in the well. To close off a higher zone in a wellbore from a lower zone in a wellbore a plug is positioned in the wellbore at a point adjacent the top of the zone to be sealed.

Generally, the plug is set by applying a force in the front of the plug and a force on the rear of the plug that compresses the plug to force slips and elastomer into contact with the wellbore. A plug may be run into the well on the end of a tubular, wireline, tractor, or other means. Unfortunately, on occasion the plug will run into an obstruction within the wellbore. With weight on the rear of the plug and an obstruction preventing the front of the plug from moving further into the wellbore it was possible for a plug to become prematurely set within the wellbore.

SUMMARY

In a current embodiment the plug the present invention allows for the plug to be connected to the surface by a center mandrel. The center mandrel is attached to the plug only at the front end of the plug and the front end of the mandrel. Generally, the center mandrel will be connected to the plug by shear device, preferably shear threads. By connecting the mandrel to the plug only at the nose of the plug the body of the plug is drawn into the well behind the nose so that should the plug encounter an obstruction within the wellbore force applied to the plug on its leading nose via the center mandrel is applied only to the nose of the plug in order to overcome the instruction and without applying a load to the rear of the plug which would otherwise cause the plug to prematurely set.

An additional feature of the present embodiment is that the rear of the plug the mandrel passes through a seat. The mandrel incorporates a shoulder that interfaces with the seat such that the shoulder interfacing with the seat at the rear of the plug and mandrel connected to the front of the plug allows the plug to be assembled so that the mandrel holds the various components of the plug together until the plug is set.

Upon setting the mandrel is generally removed from the plug on some instances the mandrel may be allowed to remain in place. In order to remove the mandrel from the plug additional force is applied to the mandrel in excess of the force that was required to set plug in the first instance. The additional force applied to the mandrel causes the shear device such as shear screws, shear pins, or shear threads to release allowing the mandrel to be removed from the plug.

With mandrel removed fluid may flow through the plug through the cavity created through the center bore the plug when the mandrel was removed. In some embodiments a chamber is provided through the interior of the plug adjacent to the mandrel. With the mandrel in place the chamber is isolated from fluid within the wellbore. However, with the mandrel removed the chamber is now in contact with fluid within the wellbore. The chamber may contain one or more chemicals. The chemicals may be markers, salts, biocides, paraffin inhibitors, or any other chemical that may be useful downhole. In a particular embodiment a salt may be provided to accelerate the degradation or dissolution of certain compounds. In other embodiments the chamber may be provided with an electronics package. Such an electronics package to be used to determine the pressure, temperature, salinity, oil/water ratio, or other downhole information.

In certain embodiments the seat provided at the rear of the plug may be utilized such that a ball, wiper, or other obturator may be allowed to seal upon the seat to prevent fluid flow from the surface through the plug.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
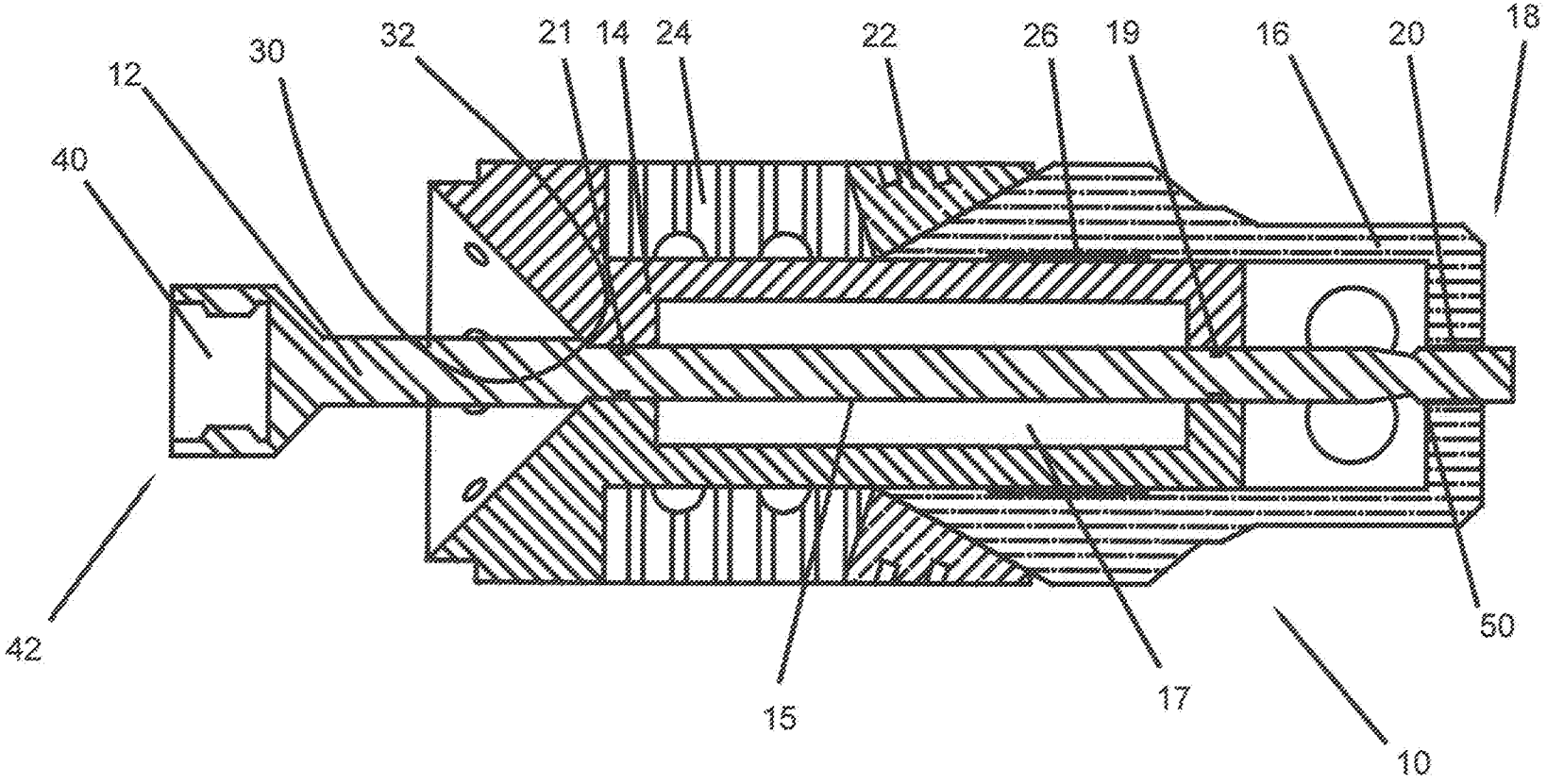
FIG. 1 is a cross-section of a plug of the present invention in its run-in condition.

FIG. 1 is a cross-section of a plug 10 of the present invention in its run-in condition. The plug 10 includes a center mandrel 12, a plug body 14, and a plug nose 16. In the mandrel 12 is attached to the forward end 18 of the plug nose 16 via shear threads 20. In the present embodiment a shear thread 20 is incorporated to facilitate assembly of the plug 10. In the present embodiment the various portions of the plug such as the slips 22, the elastomer 24, the ratchet 26, and the plug nose 16 are arranged about the plug body 14. The center mandrel 12 is positioned through the center throughbore 15 in plug body 14 and threaded into plug nose 16. In some instances the center mandrel 12 may then be tightened into the sheer threads 20 in plug nose 16 wherein shoulder 30 about center mandrel 12 engages seat 32 which is circumferential about the center bore the plug body 14. In other instances the shoulder 30 may be replaced with the shear pin, shear ring, or other shear device such that the shear force required to shear the shear device 30 is equal to or less than the force required to shear the shear threads 20 between the mandrel and the plug nose 16. In certain embodiments the nose of the mandrel may incorporate a shoulder 50 or other stop mechanism that engages with plug nose 16 that would prevent the plug nose 16 from sliding rearward on mandrel 12 in the event of any impact between debris or other sources within the wellbore with the plug nose 16.

With the center mandrel 12 threaded into plug nose 20 and in position through the center through bore 15 in plug body 14 compartment 17 is isolated from wellbore fluid by O rings 19 and 21. Plug 10 is generally run into the wellbore attached to the tubular via socket 40 at the rear end 42 of center mandrel 12.

Figure 2:
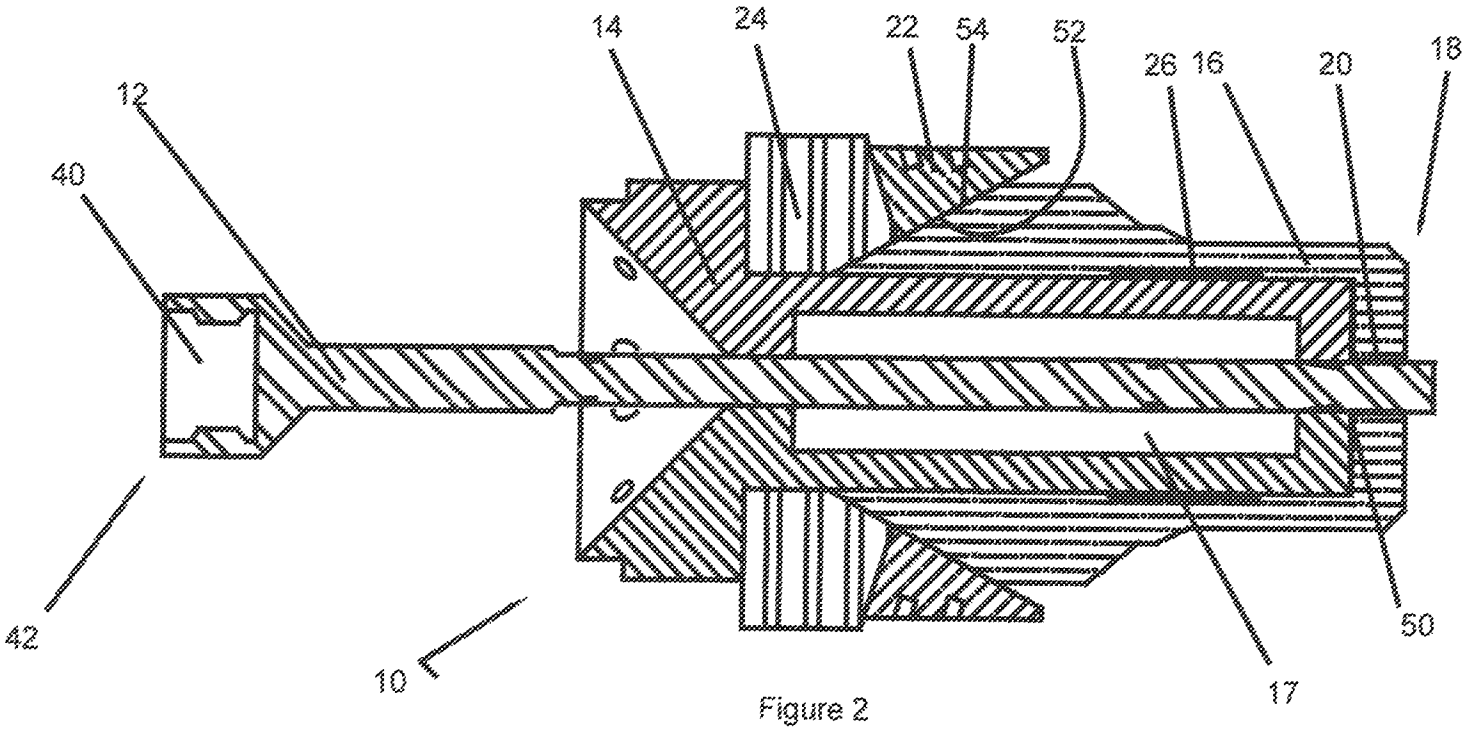
FIG. 2 is a depiction of the plug in its set position with the mandrel pulled towards the rear but not yet removed.

FIG. 2 depicts the plug 10 in its set position. Where the mandrel 12 has been pulled towards the rear 42 causing the plug nose 16 to slide rearward over plug body 14. The plug nose ramp 52 slides under the corresponding ramp 54 on slips 22 forcing slips 22 radially outward to engage the wellbore wall (not shown) regardless of whether or not wellbore wall is casing or open hole. Additionally, as plug nose ramp 52 slides towards the rear 42 elastomer 24 is compressed forcing a portion of elastomer 24 radially outward engaging the wellbore wall. In this initial set position mandrel 12 has not been removed from the plug 10 so that compartment 17 remains essentially isolated from wellbore fluid.

Figure 3:
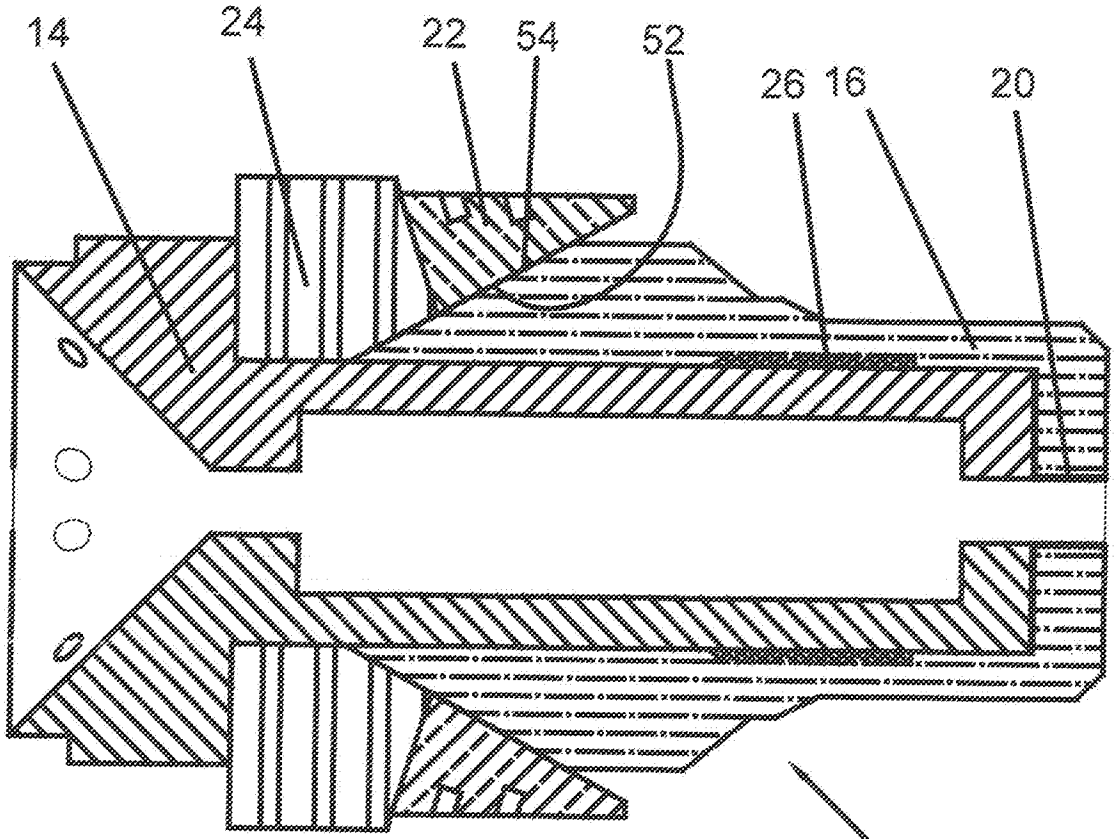
FIG. 3 depicts the set plug with mandrel removed from through bore in the plug body.

FIG. 3 depicts plug 10 with mandrel 12 removed from through bore 15 in plug body 14. With mandrel 12 removed wellbore fluid or other components with a cross-section that does not exceed the cross-section of the through bore 15 may proceed past the plug up or down through the wellbore depending upon the pressure differentials within the wellbore. With compartment 17 now exposed to wellbore fluid the contents a compartment 17 may be accessed. In a preferred embodiment a chemical may be carried within compartment 17. Such chemical may be a tracer, a compound to accelerate the dissolution of various components within the plug or the wellbore, any variety of chemicals which may be useful within the wellbore, or even an electronics package which could communicate pressure, temperature, fluid makeup, or other information with the surface. In certain embodiments the electronics package may release radiofrequency identification (RFID) tags.

Figure 4:
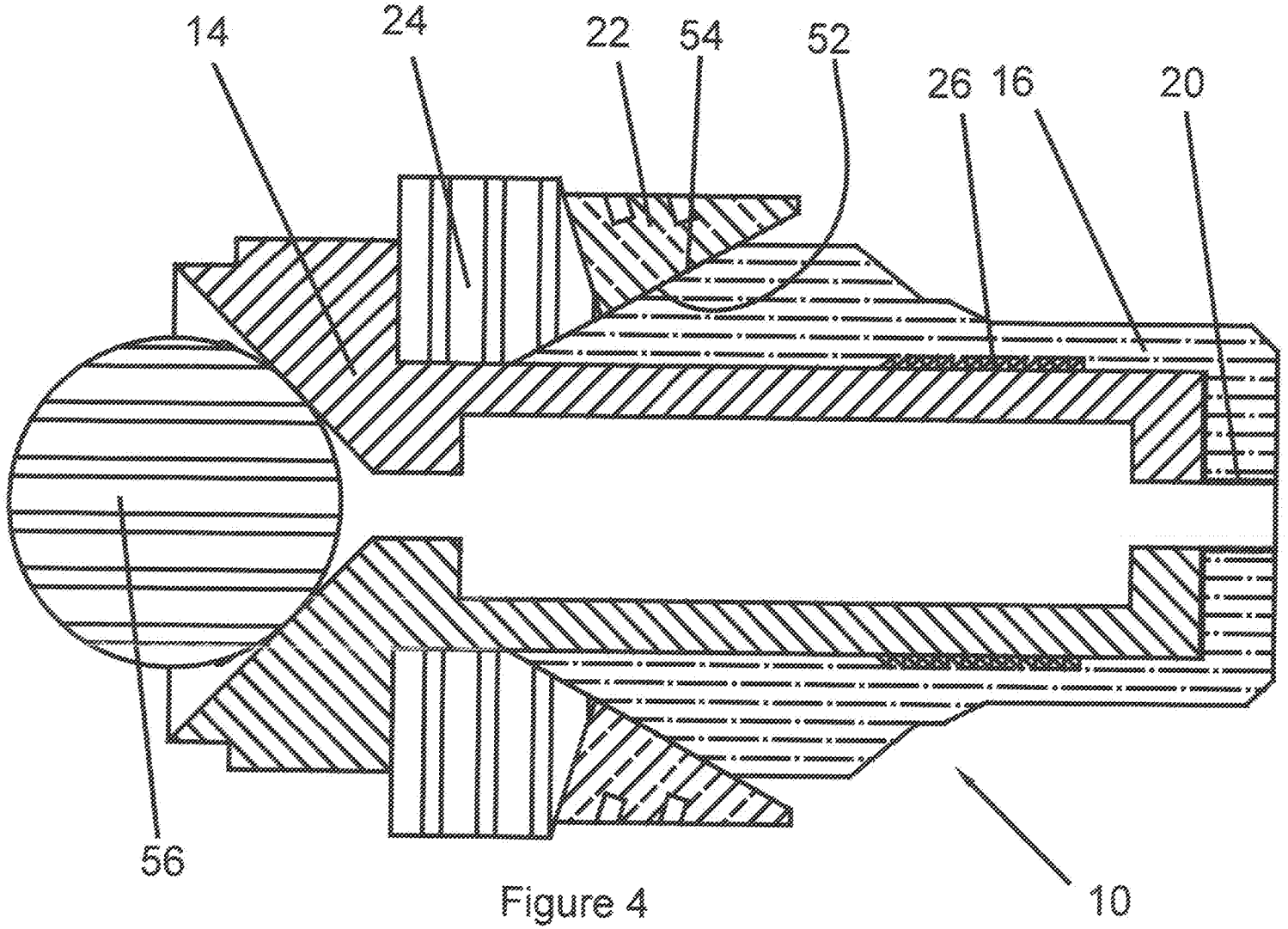
FIG. 4 depicts the plug with a ball landed upon the seat.

FIG. 4 depicts plug 10 with a ball 56 or other device landed upon seat 32 of plug body 14 blocking access to through bore 15. With access to through bore 15 blocked fluid flow from above plug 10 to below plug 10 is prevented. Further preventing chemicals that may be contained within compartment 17 from moving upwards past plug 10.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A plug comprising:

a plug body, wherein the plug body has a through bore and a cavity;

wherein the cavity is accessed via the through bore;

a plug nose, wherein the plug nose has a second through bore;

a mandrel, wherein the mandrel is within the plug body through bore and the plug nose second through bore;

wherein a shear device on a forward portion of the mandrel engages the plug nose; and wherein the mandrel is configured to pull the plug into the well by the plug nose.

2. The plug of claim 1 wherein, the mandrel engages the plug body.

3. The plug of claim 1 wherein, the mandrel has a shoulder to engage the plug body.

4. The plug of claim 1 wherein, the mandrel engages the plug body with a second shear device.

5. The plug of claim 1 wherein, the shear device is a shear threads.

6. The plug of claim 1 wherein, the plug body has a seat on a rearward facing surface.

7. The plug of claim 1 wherein, the cavity contains a chemical.

8. The method of inserting a plug into a wellbore comprising:

attaching a mandrel to a plug nose;

attaching the plug nose to a plug body such that the plug body follows the plug nose;

running the mandrel, plug body, and plug nose into a wellbore; and pulling the plug into the well by the plug nose.

9. The method of claim 8 wherein, the plug nose has a through bore and the plug body has a second through bore; further wherein the mandrel passes through the plug body second through bore and the plug nose through bore.

10. The method of claim 8 wherein, a shear device on the forward portion of the mandrel engages the plug nose via the shear device.

11. The method of claim 8 wherein, the mandrel engages the plug body.

12. The method of claim 8 wherein, the mandrel has a shoulder to engage the plug body.

13. The method of claim 8 wherein, the mandrel engages the plug body with a second shear device.

14. The method of claim 8 wherein, shear device is a shear thread.

15. The method of claim 8 wherein, the plug body has a seat on a rearward facing surface.

16. The method of claim 8 wherein, the cavity contains a chemical.

* * * * *